US007301093B2

(12) United States Patent
Sater et al.

(10) Patent No.: US 7,301,093 B2
(45) Date of Patent: Nov. 27, 2007

(54) SYSTEM AND METHOD THAT FACILITATES CUSTOMIZING MEDIA

(75) Inventors: Neil D. Sater, 6618 Morningside Dr., Brecksville, OH (US) 44141; Mary Beth Sater, 6618 Morningside Dr., Brecksville, OH (US) 44141

(73) Assignees: Neil D. Sater, Brecksville, OH (US); Mary Beth Sater, Brecksville, OH (US)

( * ) Notice: Subject to any disclaimer, the term of this patent is extended or adjusted under 35 U.S.C. 154(b) by 894 days.

(21) Appl. No.: 10/376,198

(22) Filed: Feb. 26, 2003

(65) Prior Publication Data

US 2003/0159566 A1 Aug. 28, 2003

Related U.S. Application Data

(60) Provisional application No. 60/360,256, filed on Feb. 27, 2002.

(51) Int. Cl.
*G10H 1/00* (2006.01)
*G10H 1/18* (2006.01)
*G10H 7/00* (2006.01)

(52) U.S. Cl. ..... 84/615; 84/609; 84/649; 84/653

(58) Field of Classification Search ..... 84/600–603, 84/609–610, 615, 622–625, 634, 649–650, 84/653, 659–660, 666
See application file for complete search history.

(56) References Cited

U.S. PATENT DOCUMENTS 6,288,319 B1 * 9/2001 Catona ..... 84/609
6,572,381 B1 * 6/2003 Tsai ..... 434/307 A
6,678,680 B1 * 1/2004 Woo ..... 707/6
6,696,631 B2 * 2/2004 Smith et al. ..... 84/645
2002/0007717 A1 * 1/2002 Uehara ..... 84/600
2002/0088334 A1 * 7/2002 Mohammad Beigi ..... 84/478
2003/0029303 A1 * 2/2003 Hasegawa et al. ..... 84/609

(Continued)

OTHER PUBLICATIONS

International Search Report dated Aug. 29, 2003, for International Appl. No. PCT/US03/05969.

*Primary Examiner*—Marlon Fletcher
(74) *Attorney, Agent, or Firm*—Amin, Turocy & Calvin, LLP

(57) ABSTRACT

The present invention relates to a system and method for customizing media (e.g., songs, text, books, stories, video, audio . . . ) via a computer network, such as the Internet. A system in accordance with the invention includes a component that provides for a user to search for and select media to be customized. A customization component receives data relating to modifying the selected media and generates a customized version of the media incorporating the received modification data. A distribution component delivers the customized media to the user. The present invention solves a unique problem in the current art by enabling a user to alter media in order to customize the media for a particular subject or recipient. This is advantageous in that the user need not have any singing ability for example and is not required to purchase any additional peripheral computer accessories to utilize the present invention. Thus, customization of media can occur for example via recording an audio track of customized lyrics or by textually manipulation of the lyrics and/or graphics. In achieving this goal, the present invention utilizes client/server architecture such as is commonly used for transmitting information over a computer network such as the Internet.

24 Claims, 11 Drawing Sheets

U.S. PATENT DOCUMENTS

2003/0110926 A1* 6/2003 Sitrick et al. ..... 84/477 R
2003/0182100 A1* 9/2003 Plastina et al. ..... 704/1
2003/0183064 A1* 10/2003 Eugene et al. ..... 84/609
2004/0031378 A1* 2/2004 Hughes ..... 84/609
2004/0182225 A1* 9/2004 Ellis et al. ..... 84/476

* cited by examiner

SYSTEM AND METHOD THAT FACILITATES CUSTOMIZING MEDIA

CROSS-REFERENCE TO RELATED APPLICATION

This application claims priority to U.S. Provisional Patent Application No. 60/360,256 filed on Feb. 27, 2002, entitled METHOD FOR CREATING CUSTOMIZED LYRICS.

TECHNICAL FIELD OF THE INVENTION

The present invention relates generally to computer systems and more particularly to system(s) and method(s) that facilitate generating and distributing customized media (e.g., songs, poems, stories . . . ).

BACKGROUND OF THE INVENTION

As computer networks continue to become larger and faster, so too do applications provided thereby with respect to complexity and variety. Recently, new applications have been created to permit a user to download audio files for manipulation. A user can now manipulate music tracks to customize a favorite song to specific preferences. Musicians can record tracks individually and mix them on the Internet to produce a song, while never having met face to face. Extant song customization software programs permit users to combine multiple previously recorded music tracks to create a custom song. The user may employ pre-recorded tracks in a variety of formats, or alternatively, may record original tracks for combination with pre-recorded tracks to achieve the customized end result. Additionally, known electronic greeting cards allow users to record and add a custom audio track for delivery over the Internet.

Currently available software applications employ "Karaoke"-type recordation of song lyrics for subsequent insertion or combination with previously recorded tracks in order to customize a song. That is, a user must sing into a microphone while the song he or she wishes to customize is playing so that both the original song and the user's voice can be recorded simultaneously. Alternatively, "mixing" programs are available that permit a user to combine previously recorded tracks in an attempt to create a unique song. However, these types of recording systems can be expensive and time consuming for a user that desires rapid access to a personalized, custom recording.

SUMMARY OF THE INVENTION

The following presents a simplified summary of the invention in order to provide a basic understanding of some aspects of the invention. This summary is not an extensive overview of the invention. It is not intended to identify key/critical elements of the invention or to delineate the scope of the invention. Its sole purpose is to present some concepts of the invention in a simplified form as a prelude to the more detailed description that is presented later.

The present invention relates to a system and method for customizing media (e.g., songs, text, books, stories, video, audio . . . ) via a computer network, such as the Internet. The present invention solves a unique problem in the current art by enabling a user to alter media in order to customize the media for a particular subject or recipient. This is advantageous in that the user need not have any singing ability for example and is not required to purchase any additional peripheral computer accessories to utilize the present invention. Thus, customization of media can occur for example via recording an audio track of customized lyrics or by textually manipulation of the lyrics. In achieving this goal, the present invention utilizes client/server architecture such as is commonly used for transmitting information over a computer network such as the Internet.

More particularly, one aspect of the invention provides for receiving a version of the media, and allowing a user to manipulate the media so that it can be customized to suit an individual's needs. For example, a base media can be provided so that modification fields are embedded therein which can be populated with customized data by an individual. Once at least a subset of the fields have been populated, a system in accordance with the subject invention can generate a customized version of the media that incorporates the modification data. The customized version of the media can be generated by a human for example that reads a song or story with data fields populated therein, and sings or reads so as to create the customized version of the media which is subsequently delivered to the client. It is to be appreciated that generation of the customized media can be automated as well (e.g., via a text recognition/voice conversion system that can translate the media (including populated data fields) into an audio, video or text version thereof).

One aspect of the invention has wide applicability to various media types. For example, a video aspect of the invention can allow for providing a basic video and allowing a user to insert specific video, audio or text data therein, and a system/method in accordance with the invention can generate a customized version of the media. The subject invention is different from a home media editing system in that all a user needs to do is select a base media and provide secondary media to be incorporated into the base media, and automatically have a customized media product generated there for.

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages and novel features of the invention may become apparent from the following detailed description of the invention when considered in conjunction with the drawings.

DETAILED DESCRIPTION OF THE INVENTION

Figure 1:
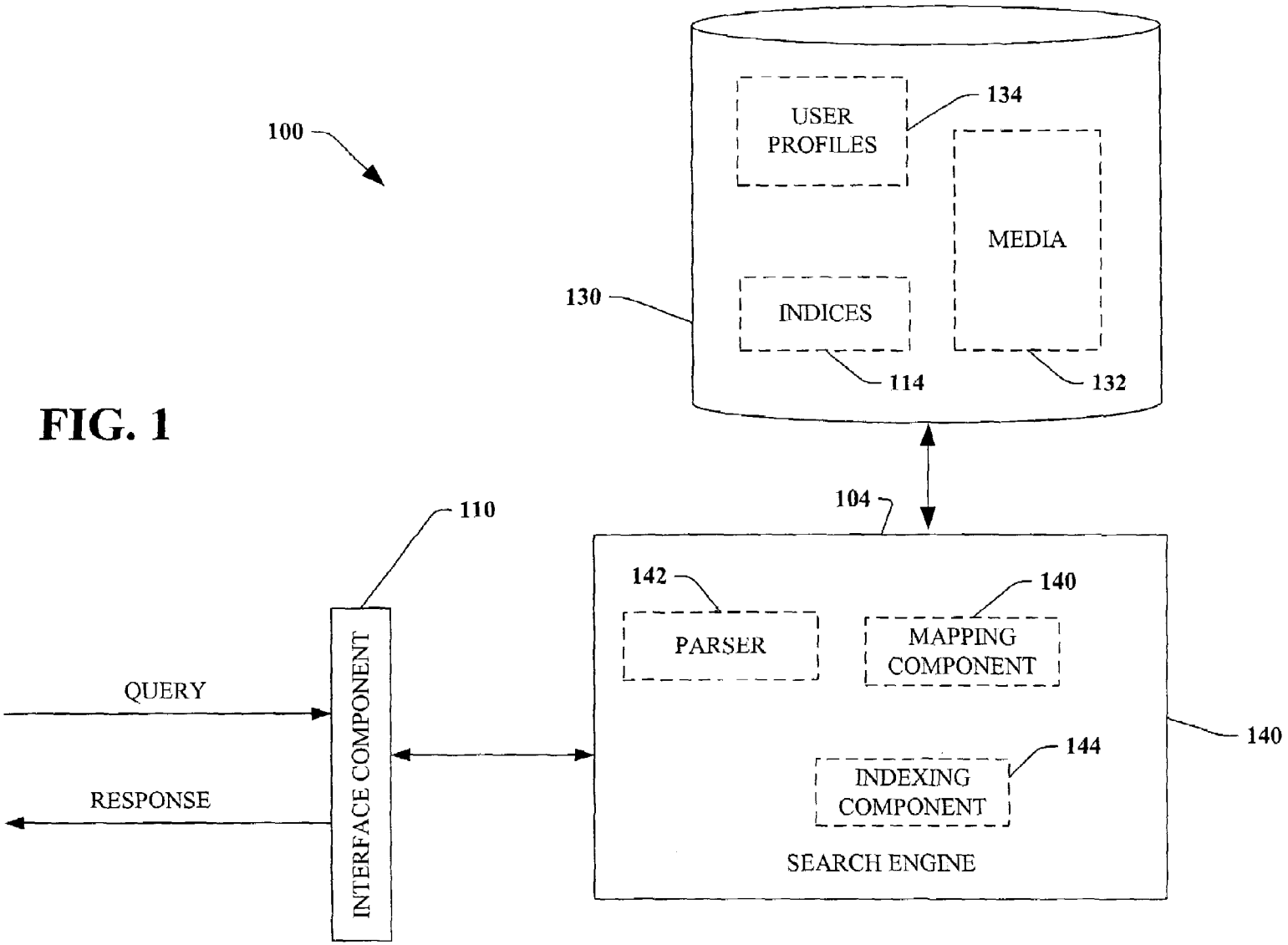
FIG. 1 is an overview of an architecture in accordance with one aspect of the present invention.

As noted above, the subject invention provides for a unique system and/or methodology to generate customized media. The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As used in this application, the terms "component," "model," "protocol," "system," and the like are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a server and the server can be a component. One or more components may reside within a process and/or thread of execution and a component may be localized on one computer and/or distributed between two or more computers.

As used herein, the term "inference" refers generally to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

To provide some context for the subject invention, one specific implementation is now described—it is to be appreciated that the scope of the subject invention extends far beyond this particular embodiment. Generalized versions of songs can be presented via the invention, which may correspond, but are not limited to, special events such as holidays, birthdays, or graduations. Such songs will typically be incomplete versions of songs where phrases describing unique information such as names, events, gender, and associated pronouns remain to be added. A user is presented with a selection of samples of generalized versions of songs to be customized and/or can select from a plurality of media to be customized. The available songs can be categorized in a database (e.g., holidays/special occasions, interests, fantasy/imagination, special events, etc.) and/or accessible through a search engine. Any suitable data-structure forms (e.g., table, relational databases, XML based databases) can be employed in connection with the invention. Associated with each song sample will be brief textual descriptions of the song, and samples of the song (customized for another subject to demonstrate by example of how the song was intended to be customized) in a .wav, a compressed audio, or other suitable format to permit the user to review the base lyrics and melody of the song simply by clicking on an icon to listen to them. Based on this sampling experience, the user selects which songs he or she wants to customize.

Upon selection, in a simple form of this invention, the user can be presented with a "lyric sheet template", which displays the "base lyrics", which are non-customizable, as well as "default placeholders" for the "custom lyric fields". The two types of lyrics (base and custom fields) can be differentiated by for example font type, and/or by the fact that only the custom lyric fields are "active", resulting in a change to the mouse cursor appearance and/or resulting in the appearance of a pop-up box when the cursor passes over the active field, or some other method. The user customizes the lyrics by entering desired words into the custom lyric fields. This customization can be performed either via pull-down-box text selection or by entering the desired lyrics into the pop-up box or by any manner suitable to one skilled in the art. When allowing free-form entering, the user can be provided with recommendations of the appropriate number of syllables for that field. In some instances, portions of a song may be repeated (for example, when a chorus is repeated), or a word may be used multiple times within a song (for example, the subject's name may be referenced several times in different contexts). When this situation occurs, the customizable fields can be "linked," so that if one instance of that field is filled, all other instances are automatically filled as well, to prevent user confusion and to keep the opportunities for customization limited to what was originally intended.

In a more complex form of the invention, the user may be required to answer questions to populate the lyric sheet. For example, the user may be asked what color the subject's hair is, and the answer would be used to customize the lyrics. Once all questions are answered by the user, the lyric sheet can be presented with the customizable fields populated, based on how the user answered the questions. The user can edit this by either going back to the questions and changing the answers they provided, or alternatively, by altering the content of the field as described above in the simple form.

The first step in pre-population of the lyric template is a process called "genderization" of the lyrics. Based on the gender of the subject (as defined by the user), the appropriate selection of pronouns is inserted (e.g. "him", "he", "his", or "her", "she", "hers", etc.) in the lyric template for presentation to the user. The process of genderization simplifies the customization process for the user and reduces the odds of erroneous orders by highlighting only those few fields that can be customized with names and attributes, excluding the pronouns that must be "genderized," and by automatically applying the correctly genderized form of all pronouns in the lyrics without requiring the user to modify each one individually. A simple form of lyric genderization involves selection and presentation from a variety of standard lyric templates. If the lyrics only have to be genderized for the primary subject, then two standard files are required for use by the system: one for a boy, with he/him/his, etc. used wherever appropriate, and one for a girl, with she/her/hers, etc. used wherever appropriate. If the lyrics must be genderized for two subjects, a total of four standard files are required for use by the system (specifically, the combinations being primary subject/secondary subject as male/male, male/female, female/male, and female/female). In total, the number of files required when using this technique is equal to 2, where n is the number of subjects for which the lyrics must be genderized.

Other techniques of genderizing the lyrics based on artificial intelligence can be employed. In many instances, the subject name entered by the user will be readily recognizable by the system as either masculine or feminine, and the system can genderize the song lyrics accordingly. However, where the subject's name is not clearly masculine or feminine, (for example, "Terry" or "Pat"), the system can prompt the user to enter further information regarding the gender of the subject. Upon entry of this information, the system can proceed with genderization of the song lyrics.

As the user enters information about the subject, that information can be stored in a subject profile database. The collection of this subject profile information is used to pre-populate other lyric templates to simplify the process of customizing additional songs. Artificial intelligence incorporated into the present invention can provide the user with recommendations for additional customizable fields based on information culled from a profile for example.

Upon entry, the custom lyrics are typically stored in a storage medium associated with a host computer of a network but can also be stored on a client computer from which the user enters the custom lyrics, or some other remote facility. Once customization is completed, the user is presented with a final customized lyric sheet for final approval. The lyric sheet is presented to the user for review either visually by providing the text of the lyrics; by providing an audio sample of the customized song through streaming audio, a .wav file, compressed audio, or some other suitable format, or a combination of the foregoing.

Upon final approval of all selections, customized lyric sheets can be delivered to the producer in the form of an order for creation of the custom song. The producer can have prerecorded tracks for all base music, as well as base lyrics and background vocals. When customizing, the producer only needs to record vocals for the custom lyric fields to complete the song. Alternatively, the producer can employ artificial intelligence to digitally simulate/synthesize a human voice, requiring no new audio recording. When completed, customized songs can be distributed on physical CD or other physical media, or distributed electronically via the Internet or other computer network, as streaming audio or compressed audio files stored in standard file formats, at the user's option.

FIG. 1 illustrates a system 100 for customizing media in accordance with the subject invention. The system 100 includes an interface component 110 that provides access to the system. The interface component 110 can be a computer that is accessed by a client computer, and/or a website (hosted by a single computer or a plurality of computer), a network interface and/or any suitable system to provide access to the system remotely and/or onsite. The user can query a database 130 (having stored thereon data such as media 132 and/or profile related data 134 and other data (e.g., historical data, trends, inference related data . . . ) using a search engine 140, which processes in part the query. For example, the query can be natural language based—natural language is structured so as to match a user's natural pattern of speech. Of course, it is to be appreciated that the subject invention is applicable to many suitable types of querying schemes. The search engine 140 can include a parser 142 that parses the query into terms germane to the query and employs these terms in connection with executing an intelligible search coincident with the query. The parser can break down the query into fundamental indexable elements or atomic pairs, for example. An indexing component 144 can sort the atomic pairs (e.g., word order and/or location order) and interacts with indices 114 of searchable subject matter and terms in order to facilitate searching. The search engine 140 can also include a mapping component 146 that maps various parsed queries to corresponding items stored in the database 130.

The interface component 110 can provide a graphical user interface to the user for interacting (e.g., conducting searches, making requests, orders, view results . . . ) with the system 100. In response to a query, the system 100 will search the database for media corresponding to the parsed query. The user will be presented a plurality of media to select from. The user can select one or more media and interact with the system 100 as described herein so as to generate a request for a customized version of the media(s). The system 100 can provide for customizing the media in any of a variety of suitable manners. For example, (1) a media can be provided to the user with fields to populate; (2) a media can be provided in whole and the user allowed to manipulate the media (e.g., adding and/or removing content); (3) the system 100 can provide a generic template to be populated with personal information relating to a recipient of the customized media, and the system 100 can automatically merge such information with the media(s) en masse or serially to create customized versions of the media(s). It is to be appreciated that artificial intelligence based components (e.g., Bayesian belief networks, support vector machines, hidden Markov models, neural networks, non-linear trained systems, fuzzy logic, statistical-based and/or probabilistic-based systems, data fusion systems, etc.) can be employed to deterministically generate the customized media in a manner the system 100 in accordance with an inference as to the customized version ultimately desired by the user. In accordance with such end, historical, demographic and/or profile-type information can be employed in connection with the inference.

Figure 2:
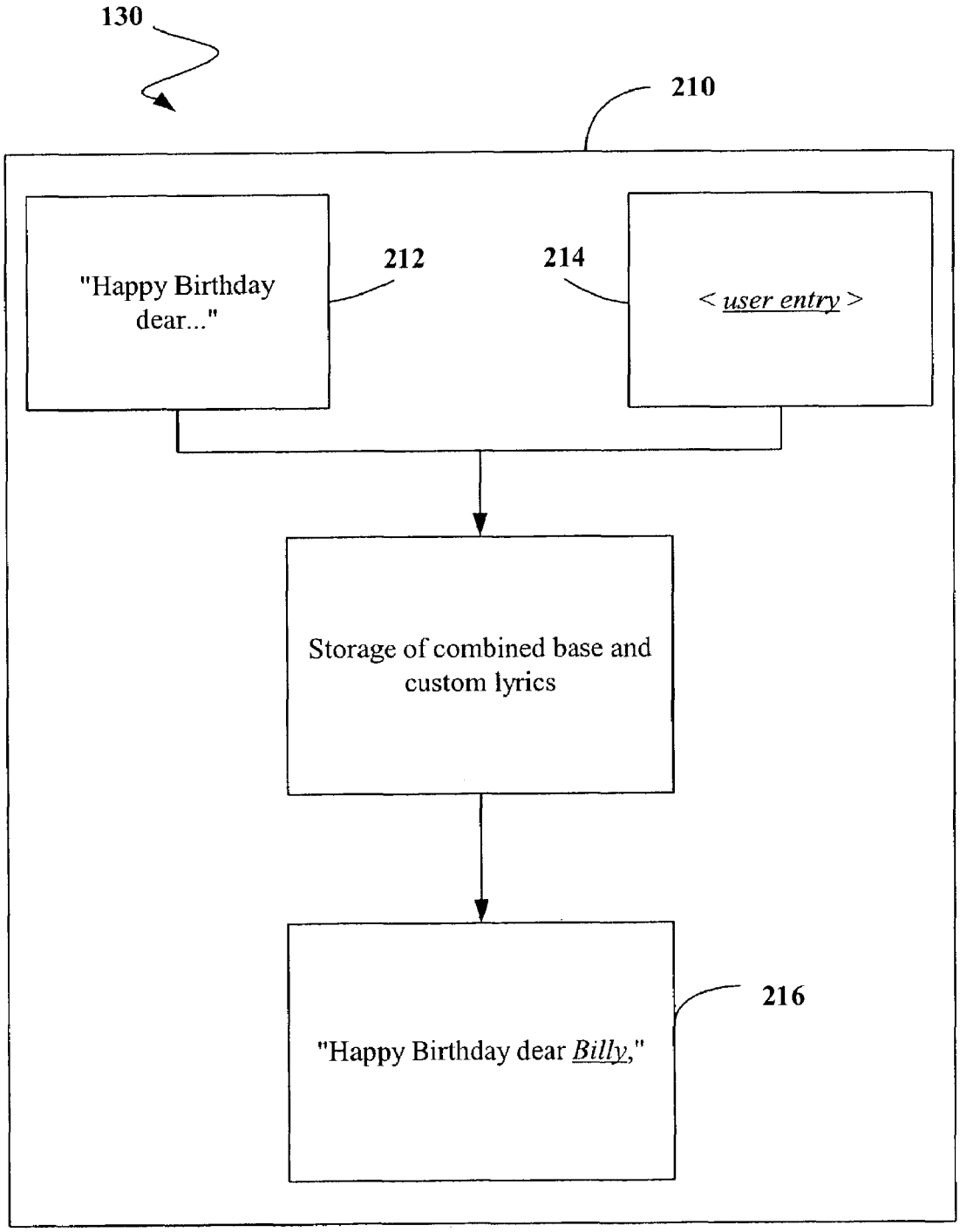
FIG. 2 illustrates an aspect of the present invention whereby a user can textually enter words to customize the lyrics of a song.

FIG. 2 illustrates an exemplary lyric sheet template that can be stored in the database 130. Upon selection of a song for customization, a user can be presented with the lyric sheet template 210, which displays non-customizable base lyrics 212 and default placeholders for custom lyric fields 214. The two types of lyrics (base and custom fields) can be differentiated by a variety of manners such as for example, field blocks, font type, and/or by the fact that only the custom lyric fields 214 are "active", resulting in a change to the mouse cursor appearance and/or resulting in the appearance of a pop-up box when the cursor passes over the active field, or any other suitable method. The user can customize the lyrics by entering desired words into the custom lyric fields 214. This customization can be performed either via pull-down-box text selection or by entering the desired lyrics into the pop-up box. When allowing free-form entering, the user can be provided with recommendations of the appropriate number of syllables for that field.

Upon entry, the custom lyrics are typically stored in a storage medium associated with the system 100 but can also be stored on a client computer from which the user enters the custom lyrics. Once customization is completed, the user is presented with a final customized lyric sheet 216 for final approval. The customized lyric sheet 216 is presented to the user for review either visually by providing the text of the lyrics; by providing an audio sample of the customized song through streaming audio, a .wav file, compressed audio, video (e.g., MPEG) or some other format, or a combination of the foregoing.

Figure 3:
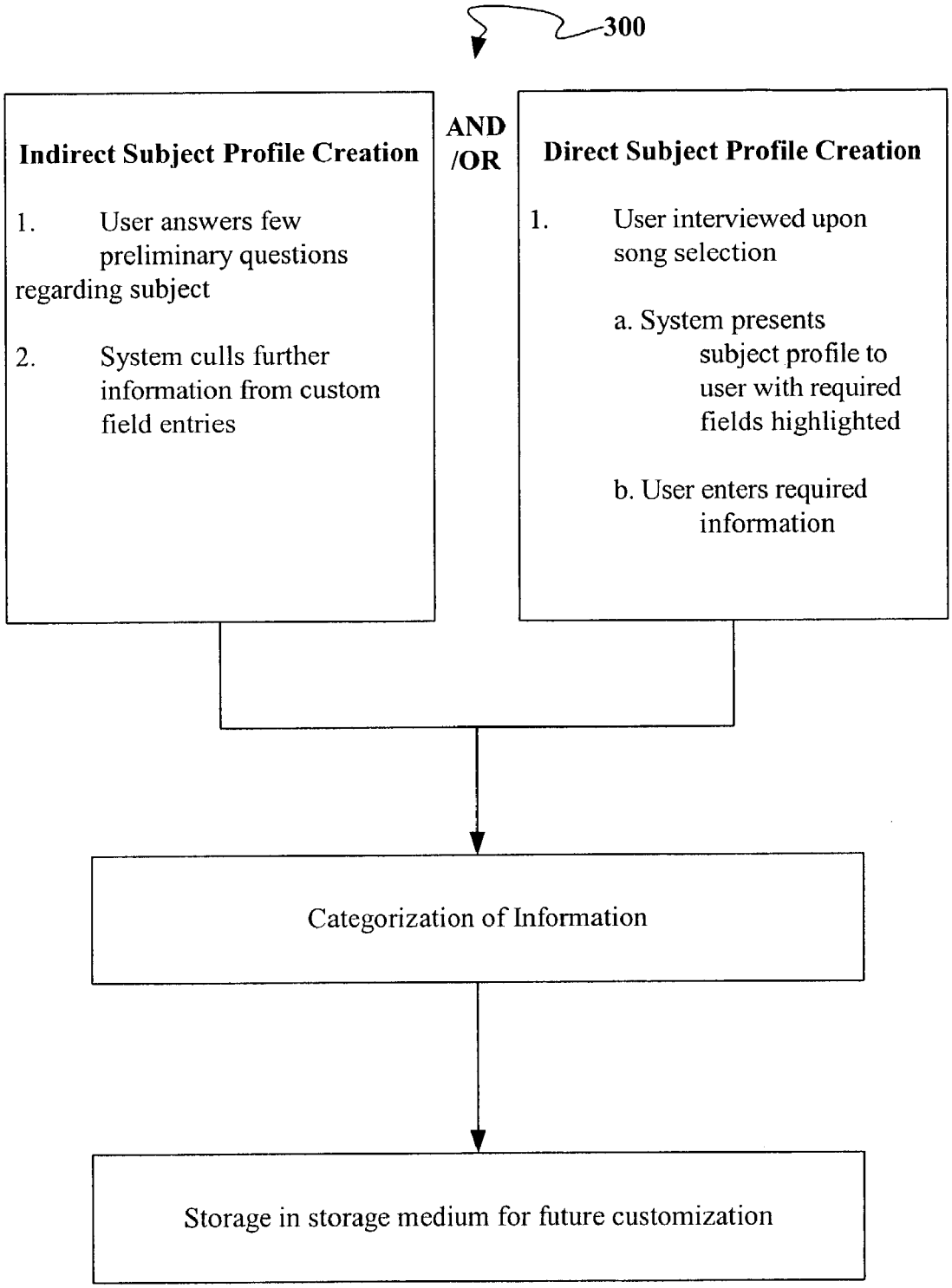
FIG. 3 illustrates the creation of a subject profile database according to an aspect of the present invention.

FIG. 3 illustrates a general overview of the creation of a profile database 300 in accordance with the subject invention. Building of the subject profile database 300 can occur either indirectly during the process of customizing a song, or directly, during an "interview" process that the user undergoes when beginning to customize a song. Alternatively, a combination of both methods of building the subject profile database 300 can be used. The direct interview may be conducted in a variety of ways including but not limited to: in the first approach, when a song is selected, the subject profile would be presented to the user with all required fields highlighted (as required for that specific song); in the second approach, only those few required questions might be asked about the subject initially. After this initial "interview", additional information about the subject would be culled and entered into the subject profile database 300, based on information the user has entered in the custom lyric fields 214 (indirect approach). All subject profile information that is collected during the customization of the song template is stored in the subject profile database 300 and used in the customization of future songs.

Figure 4:
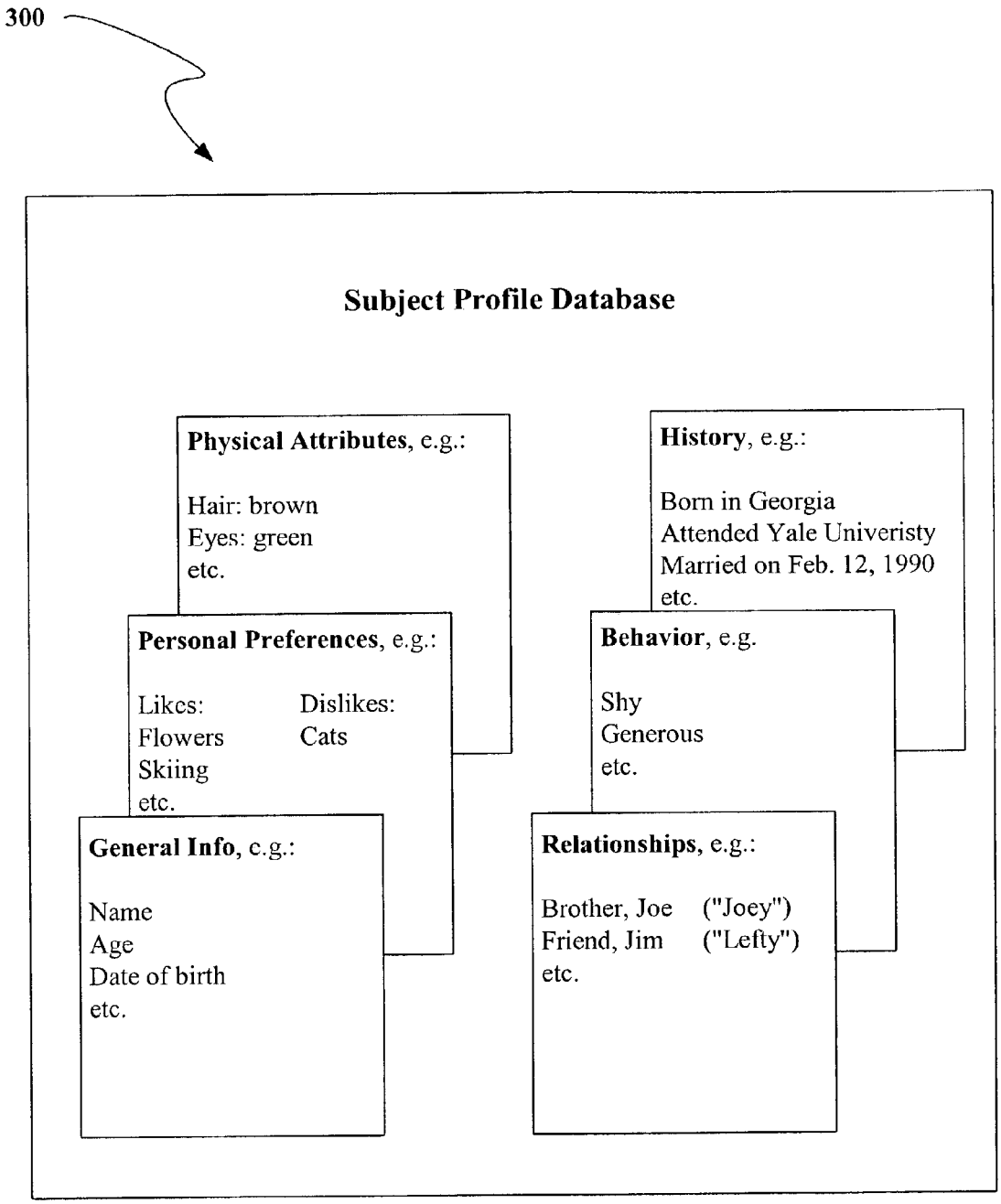
FIG. 4 illustrates an aspect of the present invention wherein information stored within the subject profile database is categorized.

According to an aspect of the present invention, information is categorized as it is stored in the subject profile database 300 (FIG. 4). For example, one category would contain general information (name, gender, date of birth, color of hair, residence street name, etc.), another category may contain information about the subject's relationships (sibling, friend, neighbor, cousin names, what the subject calls his or her mother, father, grandmothers, grandfathers, etc.). Additionally, the subject profile database 300 can contain several tiers of categories, including but not limited to a relationship category, a physical attributes category, a historical category, a behavioral category and/or a personal preferences category, etc. As subject profile database 300 grows, an artificial intelligence component in accordance with the present invention can simplify the customization process by generating appropriate suggestions regarding known information.

Figure 5:
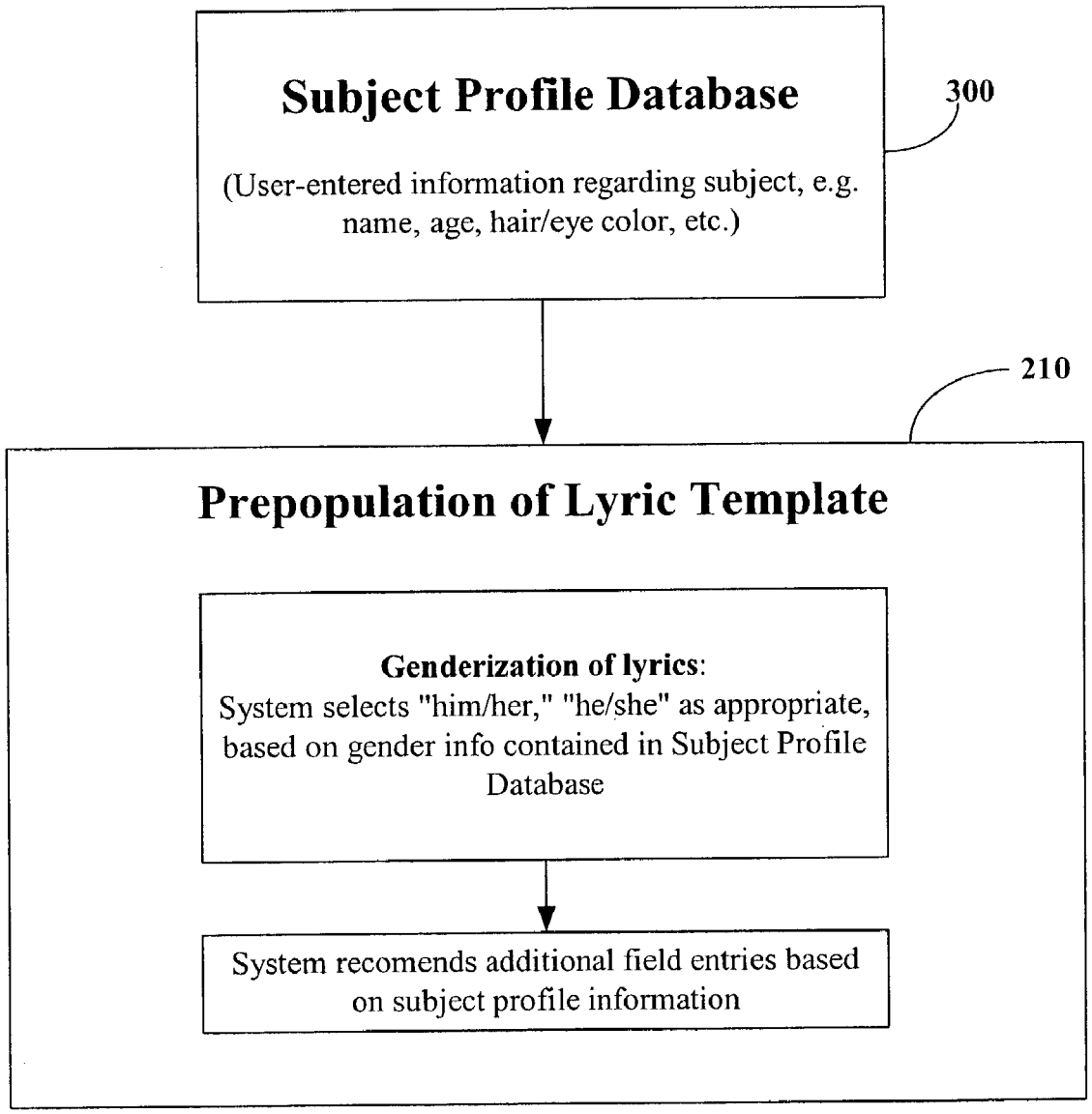
FIG. 5 illustrates an aspect of the present invention relating to prepopulation of a template.

FIG. 5 illustrates an overview of the process for pre-populating lyric templates 210 via using information stored in the subject profile database 300 to "genderize" the lyrics. As the user enters information about the subject person, that information is stored in the subject profile database 300. The collection of this subject profile information is used to pre-populate other lyric sheet templates 210.

After the lyric template is genderized, additional recommendations are presented in pull-down boxes associated with the customizable fields, based on information culled from the subject profile database 300. For example, if the profile contains information that the subject has a brother named "Joe", and a friend named "Jim", the pull-down list may offer the selections "brother Joe" and "friend Jim" as recommendations for the custom lyric field 214. Artificial intelligence components in accordance with the present invention can be employed to generate such recommendations.

Figure 6:
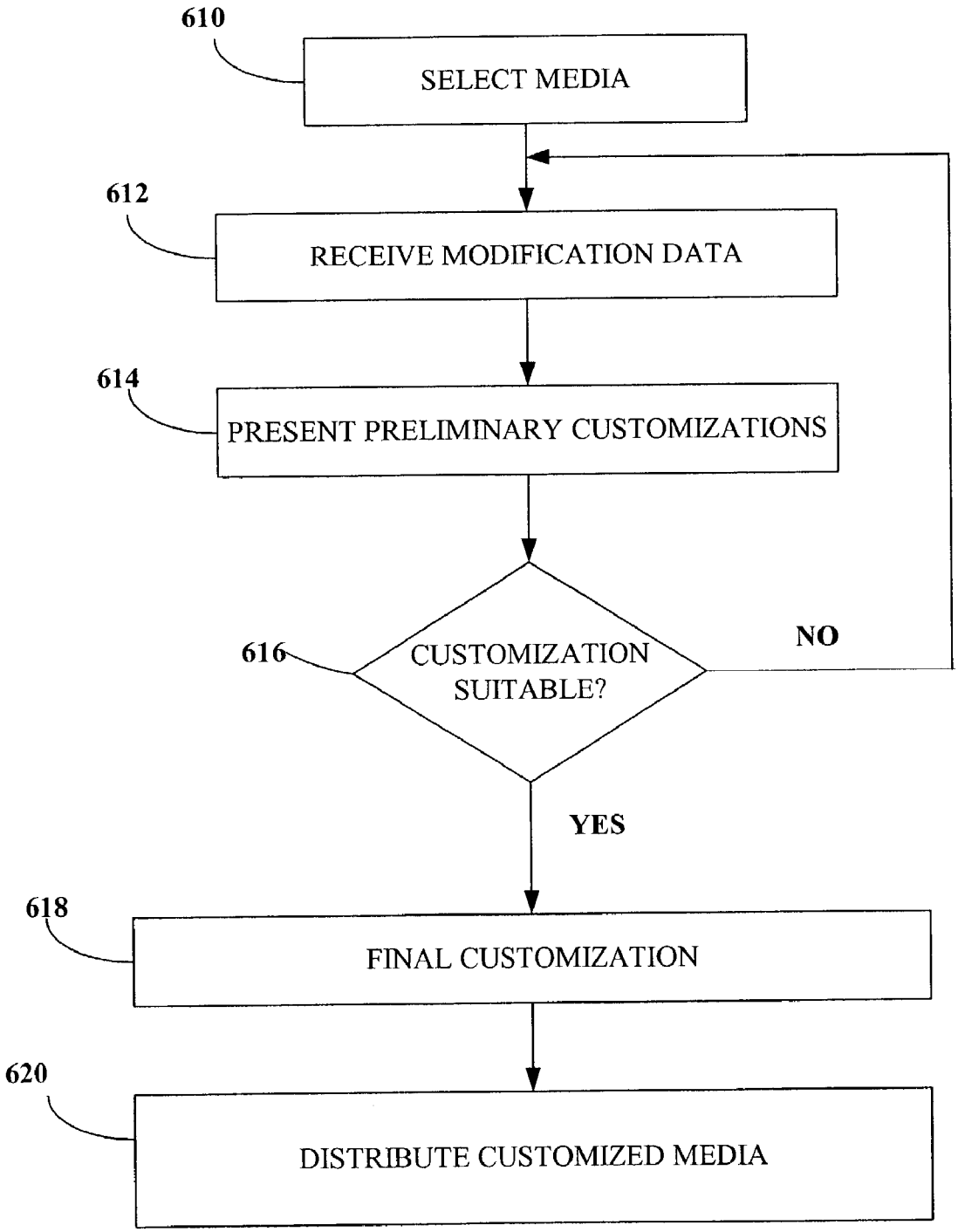
FIG. 6 is a flow diagram illustrating basic acts involved in customizing media according to an aspect of the present invention.
Figure 7:
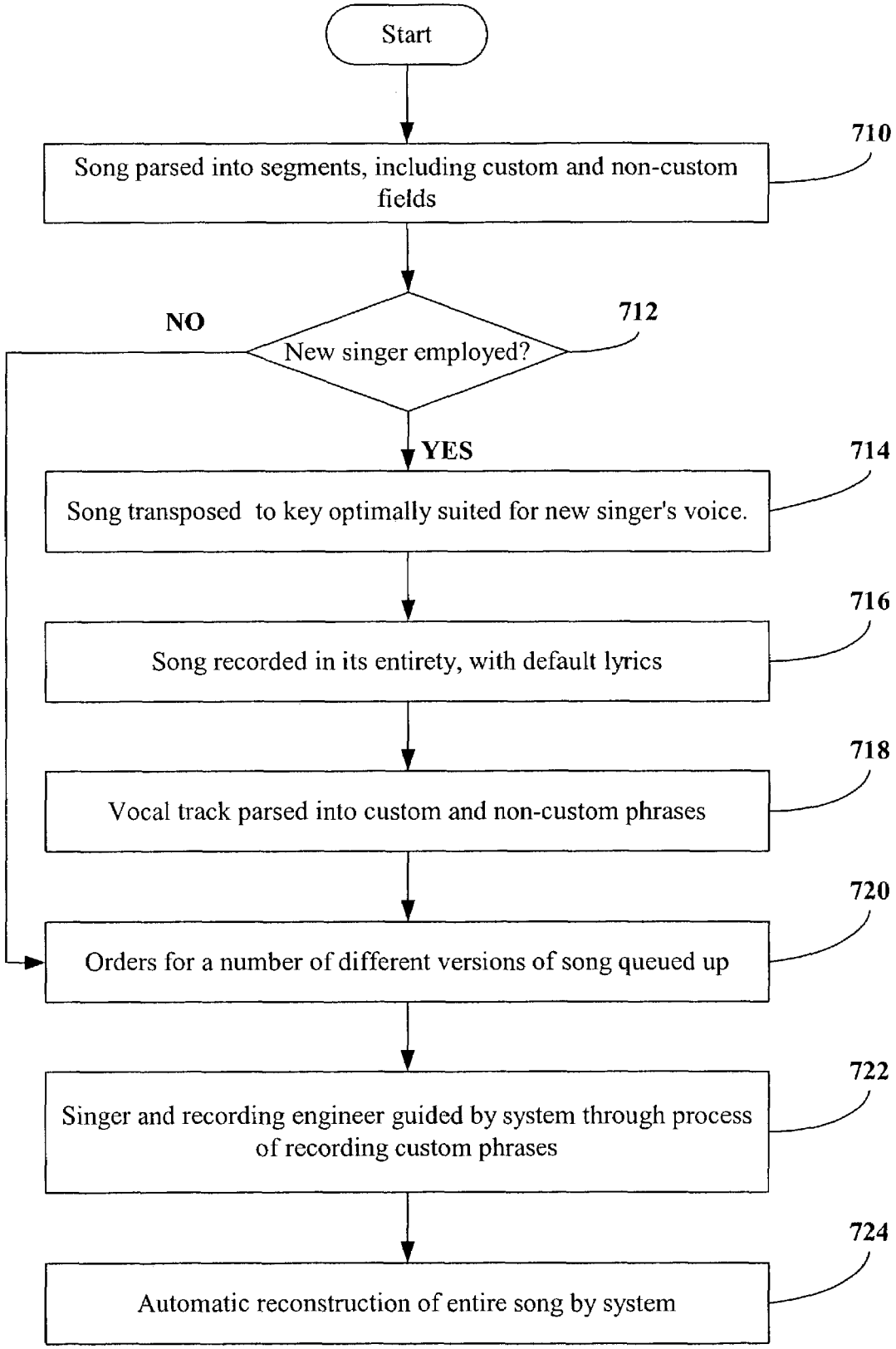
FIG. 7 is a flow diagram illustrating a systematic process of song customization and reconstruction in accordance with the subject invention.

In view of the exemplary systems shown and described above, methodologies that may be implemented in accordance with the present invention will be better appreciated with reference to the flow diagrams of FIGS. 6-7. While, for purposes of simplicity of explanation, the methodology is shown and described as a series of acts or blocks, it is to be understood and appreciated that the present invention is not limited by the order of the acts, as some acts may, in accordance with the present invention, occur in different orders and/or concurrently with other acts from that shown and described herein. Moreover, not all illustrated acts may be required to implement the methodology in accordance with the present invention. The invention can be described in the general context of computer-executable instructions, such as program modules, executed by one or more components. Generally, program modules include routines, programs, objects, data structures, etc. that perform particular tasks or implement particular abstract data types. Typically the functionality of the program modules can be combined or distributed as desired in various embodiments.

FIG. 6 shows an overview of basic acts involved in customizing media. At 610 the user selects media from a media sample database. At 612 information relating to customizing the media is received (e.g., by entering content into a data field). At 614, the user is presented with customizations made to the media. At 616 a determination is made as to the sufficiency of the customizations thus far. If suitable, the process proceeds to 618 where the media is prepared for final customization (e.g., a producer prepares media with aid of human and/or computing system—the producer can have pre-recorded tracks for base music, as well as base lyrics and background vocals. When customizing, the producer only needs to insert vocals for the custom lyric fields to complete the song. The producer can accomplish such end by employing humans, and/or computers to simulate/synthesize a human voice, including the voice in the original song, thus requiring no new audio recording, or by actually recording a professional singer's voice. If at 616 it is determined that further customization and/or edits need to be made, the process returns 612. After 618 is completed the customized media is distributed at 620 (e.g., distributed on physical mediums, or via the Internet (e-mail, downloads . . . ) or other computer network, as streaming audio or compressed data files stored in standard file formats, or by any other suitable means).

FIG. 7 illustrates general acts employed by a producer in processing a user's order. When recording customized vocals, various techniques are described to make the process more efficient (e.g., to minimize production time). At 710, a song is parsed into segments, which include both non-custom sections (e.g., phrases) and custom sections. At 712, the producer determines whether a new singer is employed: if a new singer is employed, the song is transposed to a key that is optimally suited to their voice range at 714. If no new singer is employed, then the process goes directly to act 720. At act 716, the song is recorded in its entirety, with default lyrics. At 718, a vocal track is parsed into phrases that are non-custom and custom. At 720, a group of orders for a number of different versions of the song is queued. The recording and production computer system have been programmed to intelligently guide the singer and recording engineer using a graphical interface through the process of recording the custom phrases, sequentially for each version that has been ordered, as illustrated at 722. After recording, the system automatically reconstructs each song in its entirety, piecing together the custom and non-customized phrases, and copying any repeated custom phrases as appropriate, as shown at 724. In this manner, actual recording time for each version ordered will be a fraction of the total song time, and production effort is greatly simplified, minimizing total production time and expense. In addition, even customized phrases can be pre-recorded as "semi-customized" phrases. For example, phrases that include common names, and/or fields that would naturally have a limited number of ways to customize them (such as eye or hair color) could be pre-recorded by the singer and stored for later use as needed. A database for storage of these semi-custom phrases would be automatically populated for each singer employed. As this database grows, recording time for subsequent orders would be further reduced. It should also be pointed out that an entire song does not necessarily have to be sung by the same singer. A song may be constructed in such a way that two or more voices are combined to create complementary vocal counterpoint from various vocal segments. Alternately, a song may be created using two voices that are similar in range and sound, creating one relatively seamless sounding vocal track. In one embodiment of the present invention, the gender of the singer(s) can selectable. In this embodiment, the user can be presented with the option of employing a male or female singer, or both.

Figure 8:
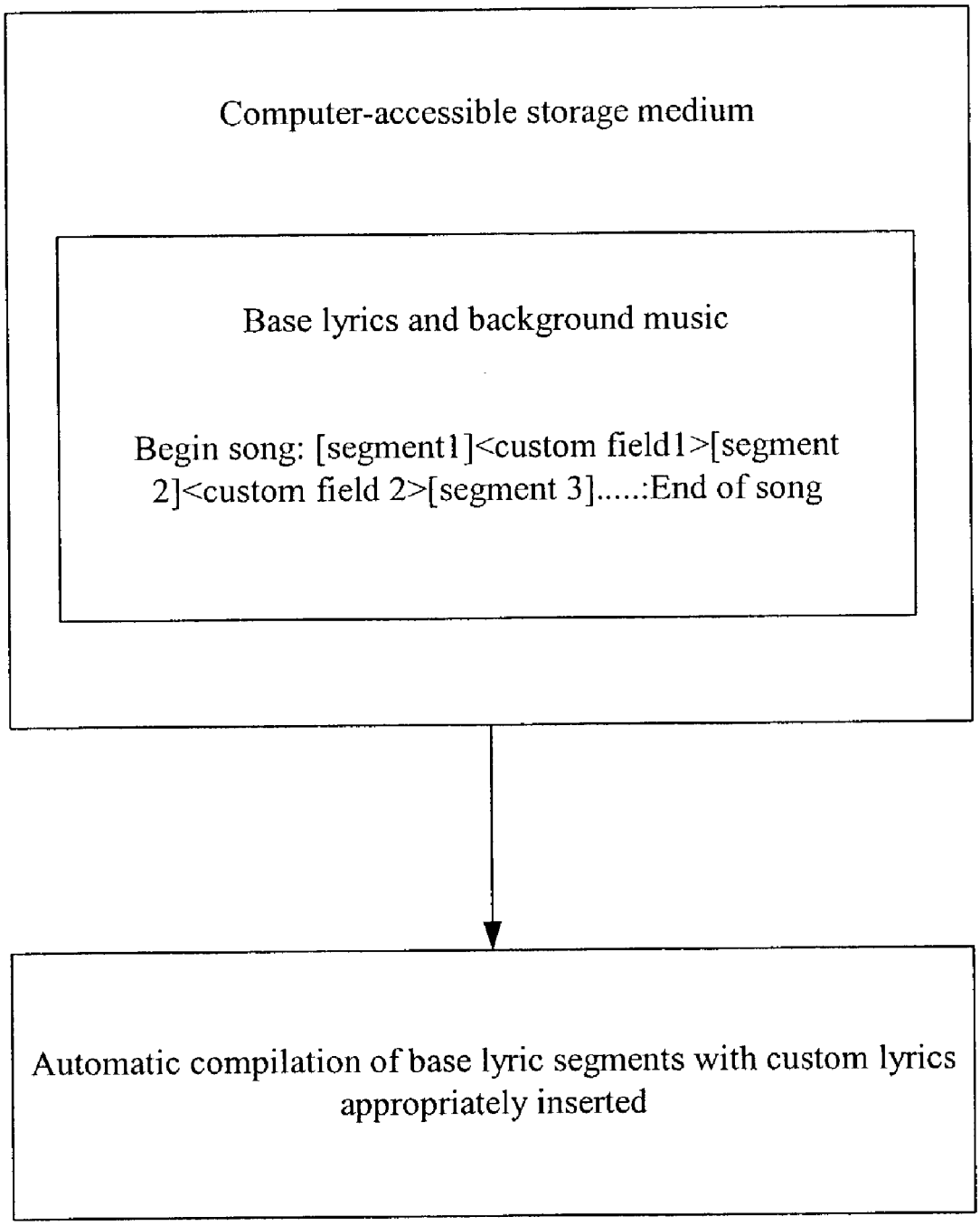
FIG. 8 illustrates an aspect of the invention wherein the customized song lyrics are stored in a manner facilitating automatic compilation of the customized song.

FIG. 8 illustrates an embodiment of the present invention in which, alternately, upon completion of the selection process, creation of the custom song may be effectuated automatically by using a computer with associated storage device, thus eliminating the need for human intervention. In such an embodiment, the base music, including the base lyrics and background voices, is digitally stored in a computer-accessible storage medium such as a relational database. The base lyrics can be stored in such a way as to facilitate the integration of the custom lyrics with the base lyrics. For example, the base lyrics may be stored as segments delimited by the custom lyric fields 214 (FIG. 2). For example, the segment of base lyrics starting with the beginning of the song and continuing to the first custom lyric field 214 (FIG. 2) is stored as segment 1. The segment of base lyrics starting with the first custom lyric field 214 (FIG. 2) and ending with the second custom lyric field 214 (FIG. 2) is next stored as segment 2. Similar storage techniques may be used for background vocals and any other part of the base music. This is continued until all of the base lyrics are stored as segments. Storage in this manner would permit the automatic compilation of the base lyric segments with the custom lyrics appropriately inserted.

As a further alternative, the base music may be separated into channels comprising the base lyrics, background vocals, and background melodies. The channels may be stored on any machine-readable medium and may have markers embedded in the channel to designate the location, if any, where the custom lyrics override the base music.

Furthermore, a technique called "syllable stretching" may be implemented to insure customized phrases have the optimum number or range of syllables, to achieve the desired rhythm when sung. This process may be performed either manually or automatically with a computer program, or some combination of both. The number (X) of syllables associated with the customized words are counted. This number is subtracted from the optimum number or range of syllables in the complete (base plus custom lyrics) phrase (Y, or Y1 thru Y2). The remainder (Z, or Z1 thru Z2) is the range of syllables required in the base lyrics for that phrase. Predetermined substitutions to the base lyrics may be selected to achieve this number. For example, the phrase "she loves Mom and Dad" has 5 syllables, whereas "she loves her Mom and Dad" has 6 syllables, "she loves Mommy and Daddy" has 7 syllables, and "she loves her Mommy and Daddy" has 8 syllables. This example illustrates how the number of syllables can be "stretched", without changing the context of the phrase. This process may be applied prior to order submission, so the user may see the exact wording that will be used, or after order submission but prior to recording and production. Artificial intelligence is employed by the present invention to recognize instances in which syllable stretching is necessary and to generate recommendations to the user or producer of the customized song.

According to one aspect of the present invention, the system is capable of recognizing the need for syllable stretching and implementing the appropriate measures to perform syllable stretching autonomously, based on an algorithm for predicting the proper insertions.

According to another aspect of the invention, the system is capable of stretching the base lyrics immediately adjacent to a given custom lyric field 214 (FIG. 2) in order to compensate for a shortage of syllables in the custom fields. Artificial intelligence incorporated into the program of the present invention will determine whether stretching the base lyrics is necessary, and to what degree the base lyrics immediately adjacent to the custom lyric field 214 (FIG. 2) should be stretched In another embodiment of the invention, a compilation of customized songs can be generated. When multiple customized songs are created by the user, the user will be able to arrange the customized songs in a desired order in the compilation. When compiling a custom CD, the user can be presented with a separate frame on the same screen, which shows a list of the current selections and a detailed summary of the itemized and cumulative costs. "Standard compilations" may also be offered, as opposed to fully customized compilations. For example, a "Holiday Compilation" may be offered, which may include songs for Valentine's Day, Birthday, Halloween, and Christmas. This form of bundling may be used to increase sales by encouraging the purchase of additional songs through "non-linear pricing discounts" and can simplify the user selection process as well.

Additional customization of the compilation can include images or recordings provided by the user, including but not limited to pictures, icons, or video or voice recordings. The voice recording can be a stand-alone message as a separate track, or may be embedded within a song. In one embodiment, the display of the images or video provided by the user will be synchronized with the customized song. Submission of custom voice recordings can be facilitated via a "recording drop box" or other means of real time recording. When distributing via physical CD, graphics customization of CD packaging can include image customization, accomplished via submission of image files via an "image drop box". Song titles and CD titles may be customized to reflect the subject's name and/or interests.

According to another aspect of the invention, the user is given a unique user ID and password. Using this user ID, the user has the ability to check the status of his or her order, and, when the custom song is available, the user can sample the song and download it through the web site and/or telephone network. Through this unique user ID, information about the user is collected in the form of a user profile, simplifying the task of placing future orders and enabling targeted marketing to the individual.

Figure 9:
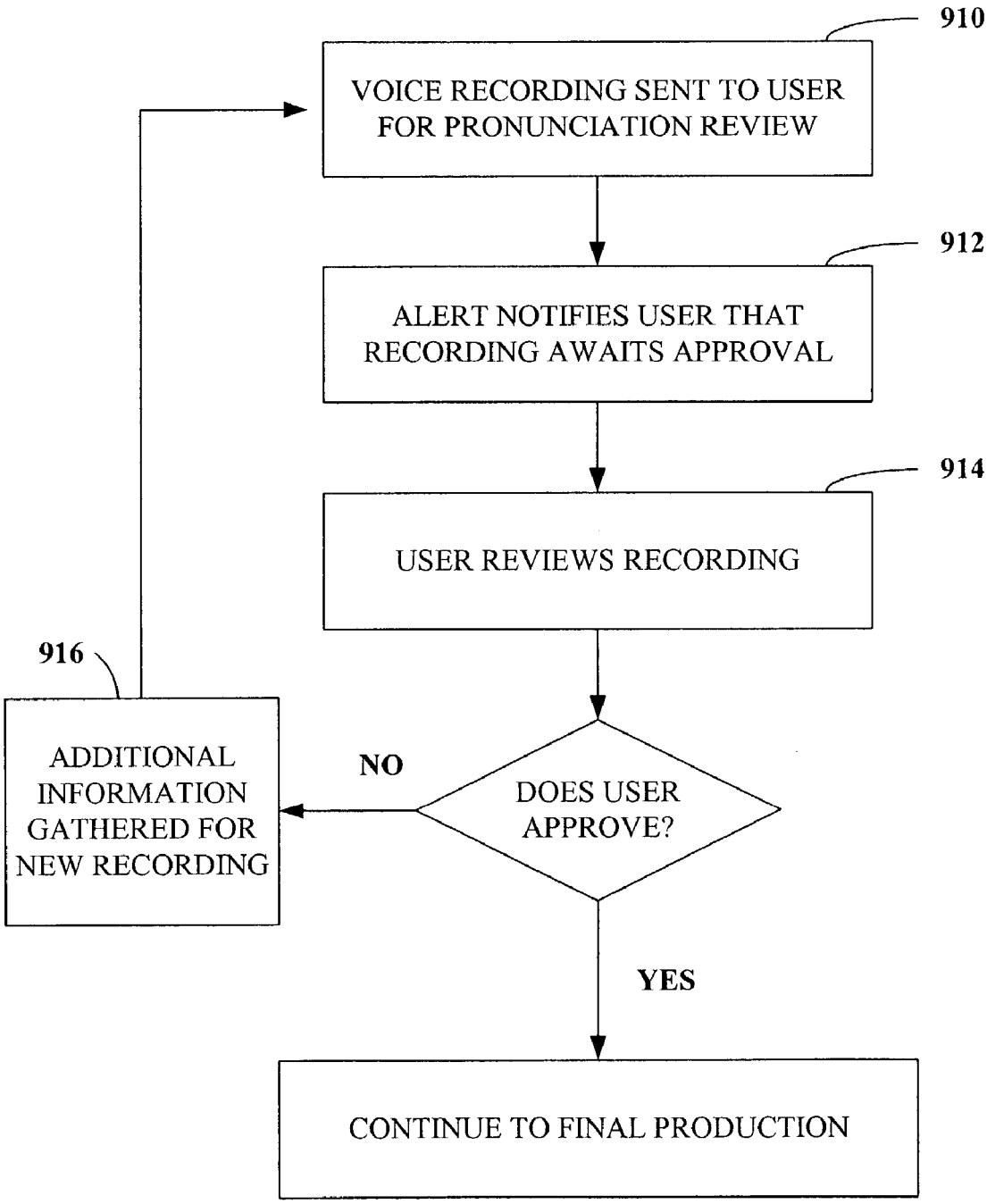
FIG. 9 is a flow diagram illustrating basic acts involved in quality verification of the customized media according to an aspect of the present invention.

Now referring to FIG. 9: A potential challenge to providing high customer satisfaction with a song customization service is the potential mispronunciation of names. To resolve this problem, one or a combination of several means are provided to permit the user to review the pronunciation for accuracy prior to production and/or finalization of the customized song. After submitting a valid order, a voice recording may be created and made available to the user to review the pronunciation in step 910. These voice recordings are made available through the web site, and an associated alert is sent to the user telling them that the clips are available for their review in step 912. Said voice recordings can also be delivered to the user via e-mail or other means utilizing a computer or telephone network, simplifying the task for the user. The user then checks them at 914 and, if they are correct, approves. Approval can take multiple forms, including telephone touchtone approval, email approval, website checkbox, instant messaging, short messaging service, etc. If one or more pronunciation is incorrect, additional information is gathered at 916, and another attempt is made. These processes are implemented in such a way that the number of acts and amount of communication required between the user and the producer is minimized to reduce cost, customer frustration, and production lead-time. To accomplish this the user is issued instructions on the process at the time of order placement. Electronic alerts are proactively sent to the user at each act of the process when the user is expected to take action before finalization, production and/or delivery can proceed (such as reviewing a recording and approving for production). Reminders are automatically sent if the user does not take the required action within a certain time frame. These alerts and reminders can be in the form of emails, phone messages, web messages posted on the web site and viewable by the recognized user, short messaging services, instant messaging, etc.

An alternative approach to verifying accurate phonetic pronunciation involves use of the telephone as a complement to computer networks. After submitting a valid order, the user is given instructions to call a toll free number, and is prompted for an order number associated with the user's order. Once connected, the automated phone system prompts the user to pronounce each name sequentially. The prompting sequence will match the text provided in the user's order confirmation, allowing the user to follow along with the instructions provided with the order confirmation. The automated phone service records the voice recording and stores it in the database, making it available to the producer at production time.

Other approaches encompassed by alternate embodiments of the present invention include offering the user a utility for text-based phonetic pronunciation, or transferring an applet that facilitates recording on the user's system and transferring of the sound files into a digital drop box. Text-to-voice technology may be used as a variation on this approach by providing an applet or other means to the user that allows them to "phonetically construct" each word on their local client device; once the word is properly constructed to the user's satisfaction, the applet transfers "instructions" for reconstruction via the computer network to the producer, whose system recreates the pronunciation based on those instructions.

Yet another embodiment involves carrying through with production, but before delivering the finished product, requiring user verification by posting or transferring a low-quality or incomplete version of the musical audio file that is sufficient for pronunciation verification but not complete, and/or not of high enough audio quality that it would be generally acceptable to the user. Files may be posted or transferred electronically over a computer network, or delivered via the telephone network. Only after user verifies accurate phonetic pronunciation and approves would the finished product be delivered in its entirety and in full audio quality.

In many cases phonetic pronunciation of all names would be easily determined, making any quality assurance step unnecessary, so the user may be given the option of opting out of this step. If the user does not choose to invoke this quality assurance step, he or she will be asked to approve a disclaimer acknowledging that he or she assumes the risk of incorrect mispronunciation.

Alternatively, the producer may opt out of the quality assurance process rather than the user. When the producer reviews an order, he or she can, in his or her judgment, determine whether or not the phonetic pronunciation is clear and correct. If pronunciation is not clear, the producer may invoke any of the previously mentioned quality assurance processes before proceeding with production of the order. If pronunciation is deemed obvious, the producer may determine that invoking a quality assurance process is not necessary, and may proceed with order production. The benefit of this scenario is the reduction of potentially unnecessary communication between the user and the producer. It should be noted that these processes are not necessarily mutually exclusive from one another; two or more may be used in combination with one another to optimize customer satisfaction.

According to another aspect of the present invention administration functionality may be designed into the system to facilitate non-technical administration of public-facing content, referred to as "content programming". This functionality would be implemented through additional computer hardware and/or software, to allow musicians or content managers to alter or upload available lyric templates, song descriptions, and audio samples, without having to "hard program" these changes. Tags are used to facilitate identifying the nature of the content. For example, the system might be programmed to automatically identify words enclosed by "(parenthesis)" to be customizable lyric fields, and as such, will be displayed to the user differently, while words enclosed by "{brackets}" might be used to identify words that will be automatically genderized.

Figure 10:
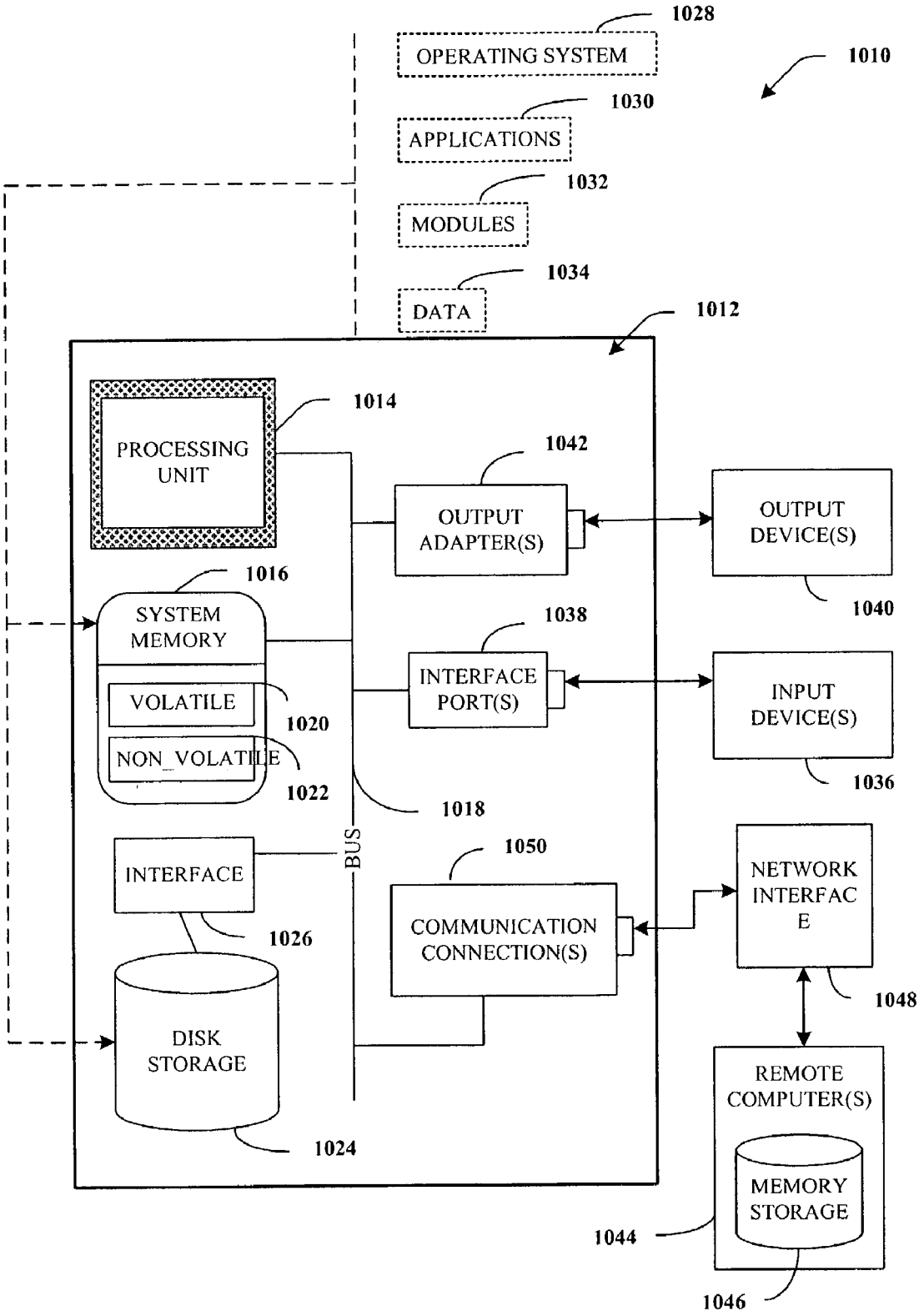
FIG. 10 illustrates an exemplary operating environment in which the present invention may function.

With reference to FIG. 10, an exemplary environment 1010 for implementing various aspects of the invention includes a computer 1012. The computer 1012 includes a processing unit 1014, a system memory 1016, and a system bus 1018. The system bus 1018 couples system components including, but not limited to, the system memory 1016 to the processing unit 1014. The processing unit 1014 can be any of various available processors. Dual microprocessors and other multiprocessor architectures also can be employed as the processing unit 1014.

The system bus 1018 can be any of several types of bus structure(s) including the memory bus or memory controller, a peripheral bus or external bus, and/or a local bus using any variety of available bus architectures including, but not limited to, 15-bit bus, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI).

The system memory 1016 includes volatile memory 1020 and nonvolatile memory 1022. The basic input/output system (BIOS), containing the basic routines to transfer information between elements within the computer 1012, such as during start-up, is stored in nonvolatile memory 1022. By way of illustration, and not limitation, nonvolatile memory 1022 can include read only memory (ROM), programmable ROM (PROM), electrically programmable ROM (EPROM), electrically erasable ROM (EEPROM), or flash memory. Volatile memory 1020 includes random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM).

Computer 1012 also includes removable/nonremovable, volatile/nonvolatile computer storage media. FIG. 10 illustrates, for example a disk storage 1024. Disk storage 1024 includes, but is not limited to, devices like a magnetic disk drive, floppy disk drive, tape drive, Jaz drive, Zip drive, LS-100 drive, flash memory card, or memory stick. In addition, disk storage 1024 can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage devices 1024 to the system bus 1018, a removable or non-removable interface is typically used such as interface 1026.

It is to be appreciated that FIG. 10 describes software that acts as an intermediary between users and the basic computer resources described in suitable operating environment 1010. Such software includes an operating system 10210. Operating system 1028, which can be stored on disk storage 1024, acts to control and allocate resources of the computer system 1012. System applications 1030 take advantage of the management of resources by operating system 1028 through program modules 1032 and program data 1034 stored either in system memory 1016 or on disk storage 1024. It is to be appreciated that the present invention can be implemented with various operating systems or combinations of operating systems.

A user enters commands or information into the computer 1012 through input device(s) 1036. Input devices 1036 include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices connect to the processing unit 1014 through the system bus 1018 via interface port(s) 1038. Interface port(s) 1038 include, for example, a serial port, a parallel port, a game port, and a universal serial bus (USB). Output device(s) 1040 use some of the same type of ports as input device(s) 1036. Thus, for example, a USB port may be used to provide input to computer 1012, and to output information from computer 1012 to an output device 1040. Output adapter 1042 is provided to illustrate that there are some output devices 1040 like monitors, speakers, and printers among other output devices 1040 that require special adapters. The output adapters 1042 include, by way of illustration and not limitation, video and sound cards that provide a means of connection between the output device 1040 and the system bus 1018. It should be noted that other devices and/or systems of devices provide both input and output capabilities such as remote computer(s) 1044.

Computer 1012 can operate in a networked environment using logical connections to one or more remote computers, such as remote computer(s) 1044. The remote computer(s) 1044 can be a personal computer, a server, a router, a network PC, a workstation, a microprocessor based appliance, a peer device or other common network node and the like, and typically includes many or all of the elements described relative to computer 1012. For purposes of brevity, only a memory storage device 1046 is illustrated with remote computer(s) 1044. Remote computer(s) 1044 is logically connected to computer 1012 through a network interface 1048 and then physically connected via communication connection 1050. Network interface 1048 encompasses communication networks such as local-area networks (LAN) and wide-area networks (WAN). LAN technologies include Fiber Distributed Data Interface (FDDI), Copper Distributed Data Interface (CDDI), Ethernet/IEEE, Token Ring/IEEE and the like. WAN technologies include, but are not limited to, point-to-point links, circuit switching networks like Integrated Services Digital Networks (ISDN) and variations thereon, packet switching networks, and Digital Subscriber Lines (DSL).

Communication connection(s) 1050 refers to the hardware/software employed to connect the network interface 1048 to the bus 1018. While communication connection 1050 is shown for illustrative clarity inside computer 1012, it can also be external to computer 1012. The hardware/software necessary for connection to the network interface 1048 includes, for exemplary purposes only, internal and external technologies such as, modems including regular telephone grade modems, cable modems and DSL modems, ISDN adapters, and Ethernet cards.

It is to be appreciated that the functionality of the present invention can be implemented using JAVA, XML or any other suitable programming language. The present invention can be implemented using any similar suitable language that may evolve from or be modeled on currently existing programming languages. Furthermore, the program of the present invention can be implemented as a stand-alone application, as web page-embedded applet, or by any other suitable means.

Additionally, one skilled in the art will appreciate that this invention may be practiced on computer networks alone or in conjunction with other means for submitting information for customization of lyrics including but not limited to kiosks for submitting vocalizations or customized lyrics, facsimile or mail submissions and voice telephone networks. Furthermore, the invention may be practiced by providing all of the above-described functionality on a single stand-alone computer, rather than as part of a computer network.

Figure 11:
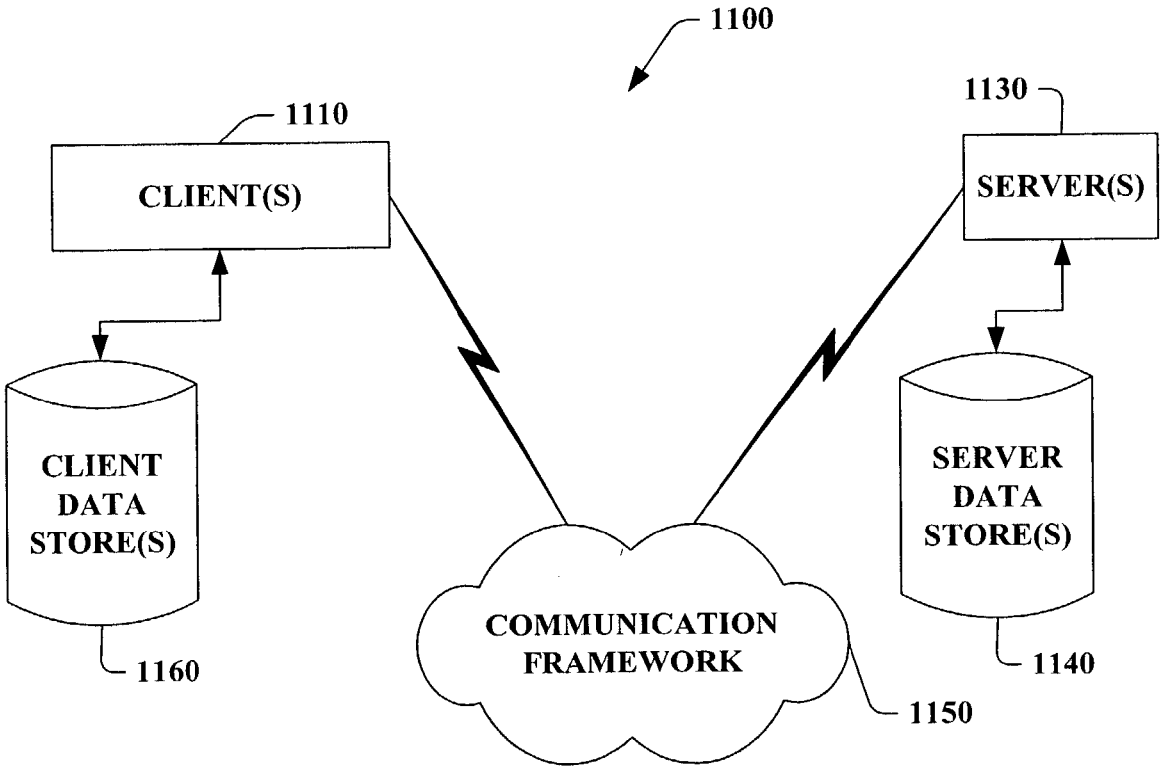
FIG. 11 is a schematic block diagram of a sample computing environment with which the present invention can interact.

FIG. 11 is a schematic block diagram of a sample computing environment 1100 with which the present invention can interact. The system 1100 includes one or more client(s) 1110. The client(s) 1110 can be hardware and/or software (e.g., threads, processes, computing devices). The system 1100 also includes one or more server(s) 1130. The server(s) 1130 can also be hardware and/or software (e.g., threads, processes, computing devices). The servers 1130 can house threads to perform transformations by employing the present invention, for example. One possible communication between a client 1110 and a server 1130 may be in the form of a data packet adapted to be transmitted between two or more computer processes. The system 1100 includes a communication framework 1150 that can be employed to facilitate communications between the client(s) 1110 and the server(s) 1130. The client(s) 1110 are operably connected to one or more client data store(s) 1160 that can be employed to store information local to the client(s) 1110. Similarly, the server(s) 1130 are operably connected to one or more server data store(s) 1140 that can be employed to store information local to the servers 1130.

What has been described above includes examples of the present invention. It is, of course, not possible to describe every conceivable combination of components or methodologies for purposes of describing the present invention, but one of ordinary skill in the art may recognize that many further combinations and permutations of the present invention are possible. Accordingly, the present invention is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A system that facilitates customizing media, comprising the following computer executable components:

a component that provides for a user to search for and select media to be customized;

a customization component that receives data relating to modifying the selected media and generates a customized version of the media incorporating the received modification data, the customization component receives the modification data via populated data fields embedded in the selected media; and a distribution component that delivers the customized media to the user.

2. The system of claim 1 further comprising an inference engine that infers a most suitable manner to incorporate the modification data.

3. The system of claim 2, to inference engine comprising at least one of: a Bayesian network, a support vector machine, a neural network, and a data fusion engine.

4. The system of claim 1, the customization component extracting the modification data from changes made to the media by the user.

5. The system of claim 1, to media being song lyrics and the customized media being a recording of a song corresponding to the song lyrics and the modification data.

6. The system of claim 1, the media being base text and the customized media being the base text modified with the modification data.

7. The system of claim 6, the text being at least one of a novel, a story and a poem.

8. The system of claim 1, the distribution component providing the customized media to the user via e-mail.

9. The system of claim 1, the distribution component providing the customized media to the user via an Internet download scheme.

10. The system of claim 1, the customization component working in conjunction with a human to generate the customized media.

11. The system of claim 1, the customization component comprising a text to voice conversion system.

12. The system of claim 1, the customization component comprising a voice recognition system.

13. The system of claim 1, the customization component comprising a pattern recognition component.

14. A computer readable medium having stored thereon the computer executable components of claim 1.

15. The system of claim 1 further comprising a component that optimizes desired pronunciation of the customized media.

16. The system of claim 1 wherein portions of the media are modified to take into consideration the gender of the subject.

17. A method that facilitates customizing a song, comprising:

providing a list of songs to a user;

receiving a request to customize a subset of the songs;

receiving respective modification data from the user, the modification data populated with selectable embedded data fields;

customizing the subset of songs using the respective modification data; and distributing the customized song to the user.

18. The method of claim 17, the act of customizing further comprising at least one of: using a human to sing the subset of songs incorporating the modification data, or using a computer to generate customized audio versions of the customized song(s) saved on a recordable medium.

19. The method of claim 17, the act of distributing comprising at least one of:

mailing the customized song(s) to the user, e-mailing the customized song(s) to the user, and downloading the customized song(s) to the user.

20. A system that facilitates customizing media, comprising the following computer executable components:

means for enabling a user to search for and select media to be customized; means for receiving data relating to modifying the selected media, the data includes one or more selectable data fields embedded in the selected media;

means for generating a customized version of the media incorporating the received modification data; and means for delivering the customized media to the user.

21. The system of claim 20 further comprising means for inferring a most suitable manner to incorporate the modification data.

22. The system of claim 20, further comprising means for verifying the quality of the customized media.

23. The system of claim 22 wherein the means for verifying the quality of the customized media is human inspection.

24. The system of claim 20, further comprising means for genderizing the customized version of the media whereby pronouns are made to agree with the gender of the subject of the received modification data.

* * * * *